United States Patent [19]

Steiger

[11] 4,364,799

[45] Dec. 21, 1982

[54] METHOD AND APPARATUS FOR CONTACTING WORK SURFACES WITH LIQUIDS

[76] Inventor: Emile Steiger, Pre-de L'etang, 1807 Blonay, Switzerland

[21] Appl. No.: 36,168

[22] Filed: May 4, 1979

Related U.S. Application Data

[63] Continuation of Ser. No. 862,652, Dec. 20, 1977, abandoned, which is a continuation of Ser. No. 726,746, Sep. 27, 1976, abandoned.

[30] Foreign Application Priority Data

Sep. 27, 1975 [CH] Switzerland ..... 12572/75

[51] Int. Cl.[3] ..... C25D 5/02

[52] U.S. Cl. ..... 204/15; 134/10; 134/21; 134/26; 134/95; 134/103; 204/224 R

[58] Field of Search ..... 134/10, 26–30, 134/57 R, 95–98, 103, 104, 172, 175, 177, 198, 21; 4/256; 239/288, 288.3, 288.5; 204/15, 224 R

[56] References Cited

U.S. PATENT DOCUMENTS

| | | | |
|---|---|---|---|
| 553,732 | 1/1896 | George | 204/224 R |
| 1,771,680 | 7/1930 | Ishisaka | 204/224 R |
| 2,229,375 | 1/1941 | Eggleston | 4/256 |
| 2,244,620 | 6/1941 | Hesse | 204/224 R |
| 2,471,506 | 5/1949 | Wiswall | 134/103 X |
| 3,276,458 | 10/1966 | Iversen et al. | 134/57 R |
| 3,294,101 | 12/1966 | Suzuki et al. | 134/103 X |
| 3,435,834 | 4/1969 | Cooper | 134/103 X |
| 3,441,035 | 4/1969 | Edwards | 134/103 |
| 3,515,094 | 6/1970 | McVey | 134/57 R X |
| 3,672,380 | 6/1972 | Schuster | 134/172 |
| 3,945,388 | 3/1976 | Clark | 134/57 R |
| 4,000,538 | 1/1977 | Tissier | 15/320 |
| 4,042,416 | 8/1977 | Miskech | 134/10 |

FOREIGN PATENT DOCUMENTS

| | | | |
|---|---|---|---|
| 26504 | of 1913 | United Kingdom | 204/224 R |

*Primary Examiner*—Marc L. Caroff
*Attorney, Agent, or Firm*—Darby & Darby

[57] ABSTRACT

A method and apparatus for treating work surfaces, such as for degreasing, plating and the like, in which the work piece is located in a treating chamber or in sealing engagement with a chamber forming sheet, which chamber forming sheet may be flexible so that it may be fitted to the area to be treated. One or more containers holding the treating fluids are provided and are selectably connectable to dispense their respective contents to the treating chamber. An arrangement is also provided to clean or purge the various containers.

2 Claims, 3 Drawing Figures

METHOD AND APPARATUS FOR CONTACTING WORK SURFACES WITH LIQUIDS

This application is a continuation of my prior copending application Ser. No. 862,652 filed Dec. 20, 1977, which in turn is a continuation of my prior and then copending application Ser. No. 726,746 filed Sept. 27, 1976, both now abandoned.

BACKGROUND OF THE INVENTION

The present invention relates to a method for treatment of surfaces, by which the surface is successively brought into contact with at least two liquids, as well as to a system for carrying out this method.

Examples of such methods, amongst others, include galvanic metal deposition or electroplating for the production of metal coatings via the anodic oxidation of aluminum with materials, since it requires the successive treatment by several baths for the production of secure coatings, such as a pickling bath, degreasing bath and galvanic bath. Heretofore the treatment took place by immersion of the surfaces to be treated, and of the work pieces, adjacent to one another in the different baths which are arranged side by side in one working area. Since, for example, the sulphuric acid, alkaline or alkali cyanide baths give off vapors particularly during their most advantageous heating, which vapors harmfully charge the breathing air, the working area must be comparatively large and must have a suction system which can provide a rapid change of air. The suction and removal of the heated area air causes a considerable loss in the heating energy.

Moreover the bath liquids are subject to an additional consumption by means of their contact with the air and the immersion of the work pieces from a preceding bath. The removal of consumed bath liquid constitutes a considerable load on the waste or sewage system.

A further difficulty arises with the known methods if larger work pieces, such as for example, ten meter-long current contact rails for power plants, are only to be treated and electroplated, respectively, on one portion of their surfaces. The covering of the surface parts which are not to be treated and the subsequent removal of the covering materials is extremely expensive. It is one object of the present invention to find a method for the liquid treatment of surfaces which avoids the previously-mentioned disadvantages and difficulties of the heretofore known processes, i.e. a method by which the surrounding area air and the waste sewage system are only slightly loaded and which may be carried out by a particularly compact and possibly mobile process system.

SUMMARY OF THE INVENTION

As an aid in the direction of the solution of the above-mentioned object, and in accordance with another object of the present invention, the present invention proposes to provide a method for the liquid treatment of surfaces of a type in accordance with the introductory mentioned paragraph, characterized in that the treatment liquids are fed to and/or removed by means of gas pressure via conduits to a treatment chamber from various supply containers. The system for the carrying out of this method is characterized by a treatment chamber which is connected by conduits with at least two supply containers and one gas source, whereby the supply containers likewise are connected with a gas source.

Advantageously the gas pressure for the filling and emptying of the container chamber by inert gas can be produced, for example by nitrogen, so that the treatment liquids are protected against the admission of air.

In order to avoid, during an exchange of the treatment liquid, the mixing of residual quantities of the previously used liquid with the new and following treatment liquid, respectively, the treatment chamber, advantageously including the conduit system, can be connected to a source of purging water. A probe or sensor can be arranged in the purging water drain or discharge conduit. The probe or sensor actuates the automatic termination of the feeding of the purging water depending on the electrical conductivity of the purging water. The rate of exchange of the treatment liquid can be increased by the arrangement of a pump in the conduit system, which pump can also serve for the continuous circulation of the treatment liquid between the treatment chamber and the respective supply container. A conservation of compressed gas and inert gas, respectively, may be achieved if during the change of the treatment liquid the gas which is to be removed from above the liquid in the respective container is compressed in a compressed or pressurized gas storage container. Because the treatment takes place, not as before in different containers, but only in the treatment chamber where the respective liquids are delivered, the treatment chamber can be arranged to be movably mounted through the use of, for example, movable or flexible connection conduits. This is particularly advantageous if only a certain surface area of a large work piece is to be treated, as for example a surface portion of an airplane, for the restoration of damaged surfaces.

An advantageous embodiment of the treatment system is a formation of the treatment chamber as a flexible elastic material which can have its shape changed within limits and then applied tightly on the work piece surface. The tight securing of the edge of the chamber on the work piece surface can be brought about by suction on the edge of the chamber which has two sealing lips extending parallel to one another, in the manner that a vacuum is applied between the sealing lips. By means of a treatment chamber executed in this manner, the covering of surface portions which are not to be treated can be avoided.

BRIEF DESCRIPTION OF THE DRAWINGS

With the above and other objects and advantages in view, the present invention will become more clearly understood from the following detailed description of preferred embodiments thereof in view of the accompanying drawings, in which.

DESCRIPTION OF PREFERRED EMBODIMENTS

Figure 1:
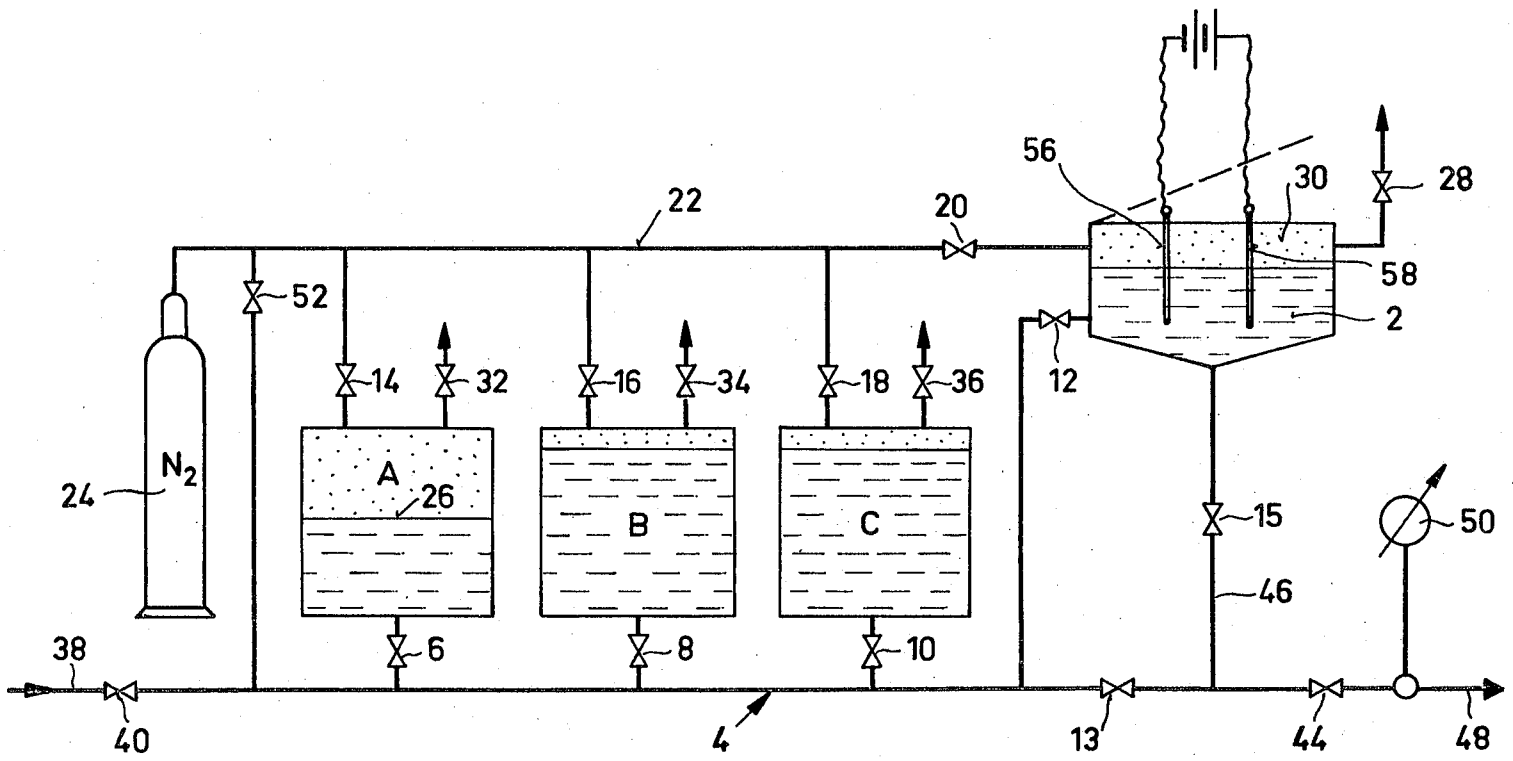
FIG. 1 is a schematic illustration of a treatment system in accordance with the present invention.

Referring now to the drawings, and particularly to FIG. 1, three supply containers, A, B and C are provided in which different treatment liquids are provided. For the galvanic treatment there is disposed in the container A, for example, an alkaline or alkali cyanide liquid for the electrolitic degreasing or scouring of the surfaces of work pieces. The container B has a liquid for heating or firing, or for electrochemical rust removal. In the container C there is an electrolyte which contains the metal precipitating or separating or depositing on the surface of the work piece. The metal is in the form of a salt, and additionally the electrolyte can contain salts for increasing its electrical conductivity, buffer substances for maintaining the pH value constant and wetting agents. Further, containers D, E, F, etc. (not illustrated) can be provided for the application or coating of several metal layers. The containers A, B, C have a closable opening (not illustrated) through which the bath can be replenished or supplemented by means of additions after partial consumption.

For the control of the bath composition a conventional device for the removal of samples can be provided or the control can take place by measuring sensors directly located in the containers, in the treatment chamber 2 or in a common tube conduit 4, which connects the containers A, B, C, with the treatment chamber 2. Each container A, B, C and the treatment chamber 2 is connected to this tubular conduit 4 via, for example, an automatically actuatable valve 6, 8, 10, 12 respectively. Moreover, each of the containers, as well as the treatment chamber, is connected to a common inert gas conduit 22 via, for example, an automatically actuatable valve 14, 16, 18 and 20. The inert gas conduit 22 is connected with a compressed or pressurized source of gas 24, for example, a nitrogen cylinder.

As a result of the embodiment illustrated in FIG. 1, for example, by means of a program controlled opening and closing of specific liquid and gas valves, a treatment liquid can be conveyed back and forth under various circumstances between one of the containers A, B, or C and the treatment chamber 2 by means of the compressed gas and possibly also by means of a pump.

If for example the treatment chamber 2 is to be filled by the liquid from the container A, then the valve 20 is closed and the valves 14, 6, 13 and 15 are opened. By means of the gas pressure acting on the liquid level 26 in the container A, the liquid flows via the conduit 4 into the treatment chamber 2. The inert gas which is to be removed from the chamber 2 thereby can escape by means of a valve 28 which is disposed in a line connected with the upper portion of the treatment chamber 2. After a sufficient liquid quantity has been ascertained for example, by means of a measuring sensor in the chamber 2, the valves 14 and 28 are closed.

The return conveyance into the container A takes place after the completion of the liquid treatment by opening of the valve 20 and with the valves 15, 13 and 6 opened so that gas from the cylinder 24 flows via the gas conduit 22 and the opened valve 20 into the gas space 30 in the upper portion of the treatment chamber 2. There the gas presses on the surface of the treatment liquid so that the liquid is pressed back into the supply container A via the opened valves 15, 13 and 6. The innocuous inert gas can then escape into the atmosphere by means of a valve 32, 34, 36, respectively or from the containers A, B and C. Before the further treatment of the surfaces of the work piece, purging of the surface so as to remove the previous liquid can be accomplished by means of water. In particular a fresh water conduit 38 which is connected to the tube conduit 4 can be operatively placed in communication with the tube conduit 4 by means of a valve 40 interposed in and between these conduits. For this purpose, the valves 40, 12, 15 and 44 are opened so that the fresh water can flow via the tubular conduit 4 into the chamber 2 and via the chamber drain conduit 46 into the sewerage conduit 48. The purging process is automatically terminated after a predetermined minimum value of the concentration of components of the treatment liquid in the purging water has been ascertained by means of the measuring sensor or probe 50. By temporarily opening the gas valve 52, the purging water can be removed from the purged system part in case it does not completely drain out under the influence of the force of gravity after closing of the valve 12 and opening of the valve 13.

Figure 2:
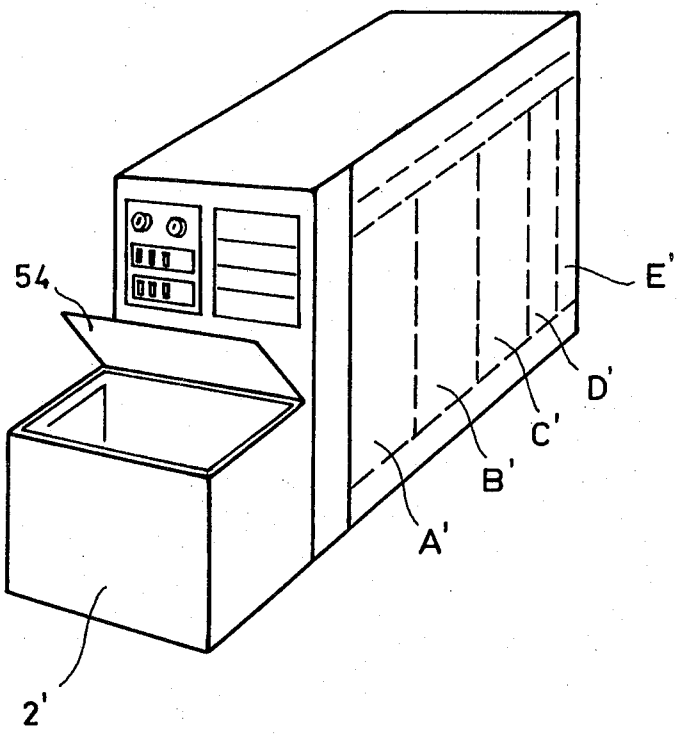
FIG. 2 is a perspective illustration of a treatment apparatus console in accordance with the present invention.

Referring now again to the drawings, and more particularly to FIG. 2, there is shown an example for the compact spacial arrangement of the treatment chamber 2' and the supply containers A', B', C' and D' with respect to one another. The inner space of the treatment chamber 2' is accessible by means of a gas tight hermetically closable cover 54. The electrodes 56, 58 (FIG. 1) are located inside of the chamber 2' by means of which a work piece (not illustrated) is to be operatively connected. The supply containers are arranged in one row behind the treatment chamber 2' and higher than the latter so that the liquid under the influence of gravitational force can flow into the treatment chamber. Devices for the automatic control and for the monitoring of the treatment system are arranged on the front side of the forward-most supply container A' above the treatment chamber.

Figure 3:
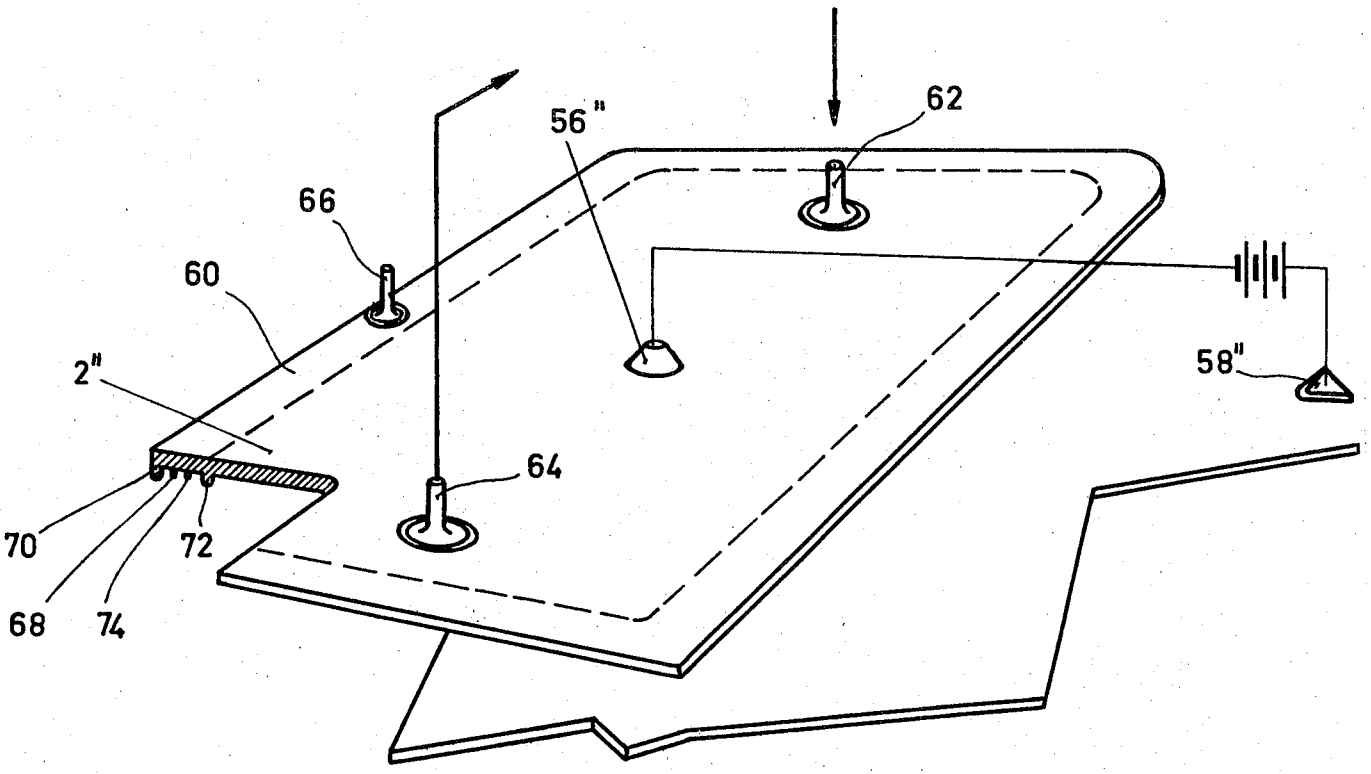
FIG. 3 is a perspective schematic illustration of a flexible treatment chamber.

FIG. 3 illustrates a particular embodiment of a treatment chamber for the treatment of work pieces, which on the basis of their size, cannot be inserted in a treatment chamber or which are to be treated only on a limited portion of their surface. This treatment chamber 2' is tightly secured to the surface of the work piece with its open (in the illustration) lower side facing the work piece longitudally of its edge 60. This chamber may comprise a flexible or rubber-type elastic synthetic material or plastic, that can easily adjust to the shape of the work piece and the portion of its surface to be treated. Besides the connections described on the basis of FIG. 1, for the feeding and removal conduit 62, 64 of the treatment liquid or for the purging, a vacuum connection 66 is provided for attachment by suction of the edge of the chamber onto the work piece surface once its shape has been changed so that it conforms to the work piece surface and covers only the area to be treated. This vacuum 66 is connected in communication with a channel-shaped space 68 between sealing lips 70, 72 of the chamber edge 60. Spacer dimples 74 are disposed between the sealing lips 70, 72. These spacer dimples 74 prevent the channel-shaped space from collapsing on the work piece surface by suction of the edge part between the sealing lips.

While there has been disclosed embodiments of the present invention, it is to be understood that these embodiments are given by example only and not in a limiting sense.

What is claimed is:

1. A method for electrochemical liquid treatment of surface portions of workpieces comprising the steps of:

providing a single sheet of a flexible elastic material having an elastic sealing means located along its edges, said sealing means including a plurality of spaced adjacent walls which extend generally parallel to one another to form a sealing space, spacer dimples being disposed within said sealing space to prevent its collapse;

forming a treatment chamber on a portion of the surface of the workpiece to be treated by forming the edges of said elastic material into a conforming shape with the periphery of the surface portion to be treated and the shape of the workpiece along its periphery, the surface portion of the workpiece being treated and said sheet of elastic material forming the treatment chamber;

applying a reduced pressure to the sealing space of said sealing means so as to firmly seal the sheet to the workpiece surface during treatment;

providing at least one treatment liquid and a closable supply container therefor;

providing (i) an electrode for said workpiece (ii) an electrode for said sheet positioned to contact said treatment liquid while within the chamber, and (iii) an electric current between said electrodes;

providing an inlet conduit and an outlet conduit at spaced locations on said sheet to provide communication between the treatment chamber and the treatment liquid supply container through the inlet conduit;

providing an inert gas under pressure;

opening the supply container and feeding the treatment liquid via said inlet conduit to said treatment chamber and withdrawing it through the outlet conduit under the pressure of said inert gas so the treatment liquid flows across the surface portion of the workpiece to treat it electrochemically, and the liquid and the surface under treatment are protected from the atmosphere.

2. A system for the electrochemical liquid treatment of surface portions of workpieces comprising:

a sheet of an elastic material which is flexible so that it can be made to correspond to the periphery of the surface portion of the workpiece to be treated and to the shape of the workpiece along its periphery;

elastic sealing means extending around the periphery of said sheet for sealing the sheet to and around the periphery of the surface portion of the workpiece to be treated so as to define a treatment chamber between said surface portion and said sheet, said sealing means including (i) spaced apart generally parallel walls of flexible material which extend along the periphery of said sheet and define a sealing space therebetween, (ii) spacer dimple means disposed in the sealing space for preventing the collapse of said sealing space and (iii) means for applying a reduced pressure to the sealing space to firmly seal the chamber forming sheet to the workpiece;

spaced apart inlet and outlet conduit means on said chamber forming sheet for respectively admitting treating liquid into and withdrawing the liquid from the treating chamber;

electrode means for said workpiece and said chamber forming sheet for contacting the treating liquid; and means for flowing the treating liquid under the pressure of inert gas across the workpiece in the treatment chamber between the inlet and outlet conduit means so as to treat electrochemically said surface portion of the workpiece.

* * * * *